US008485137B2

(12) United States Patent
Kishimoto et al.

(10) Patent No.: US 8,485,137 B2
(45) Date of Patent: Jul. 16, 2013

(54) COMBUSTION CONTROL DEVICE

(75) Inventors: Tomoki Kishimoto, Hyogo (JP); Yuji Takagi, Hyogo (JP); Masayoshi Yasukawa, Hyogo (JP); Akira Takabayashi, Hyogo (JP); Shinichi Okamoto, Hyogo (JP); Hiroshi Yakoyama, Hyogo (JP); Takashi Yashima, Hyogo (JP); Masanori Kubotani, Hyogo (JP)

(73) Assignees: Noritz Corporation, Hyogo (JP); Noritz Electronics Technology Corporation Inc., Hyogo (JP)

( * ) Notice: Subject to any disclaimer, the term of this patent is extended or adjusted under 35 U.S.C. 154(b) by 1529 days.

(21) Appl. No.: 11/661,993

(22) PCT Filed: Jan. 19, 2006

(86) PCT No.: PCT/JP2006/300696

§ 371 (c)(1),
(2), (4) Date: Mar. 6, 2007

(87) PCT Pub. No.: WO2006/080223

PCT Pub. Date: Aug. 3, 2006

(65) Prior Publication Data

US 2008/0092826 A1 Apr. 24, 2008

(30) Foreign Application Priority Data

Jan. 26, 2005 (JP) ..... 2005-018958

(51) Int. Cl.
*F24H 9/20* (2006.01)

(52) U.S. Cl.
USPC ..... 122/14.2; 122/14.1; 431/18

(58) Field of Classification Search
USPC ..... 122/14.1, 14.2, 14.3, 14.31; 431/18, 431/24, 15
See application file for complete search history.

(56) References Cited

U.S. PATENT DOCUMENTS

2003/0183177 A1* 10/2003 Kobayashi et al. ..... 122/13.01
2006/0014292 A1* 1/2006 d'Haene et al. ..... 436/55

FOREIGN PATENT DOCUMENTS

DE 3923773 * 3/1990
DE 3923773 A1 3/1990

(Continued)

OTHER PUBLICATIONS

Office Action from Deutsches Patent Office for application No. 11 2006 000 081.0-43 dated Oct. 23, 2009 with English translation.

(Continued)

*Primary Examiner* — Gregory A Wilson
(74) *Attorney, Agent, or Firm* — Rader, Fishman & Grauer PLLC

(57) ABSTRACT

The present invention relates to a combustion control device incorporated in an apparatus such as water heater and provides the combustion control device having an improved configuration with a main controller and a sub controller, capable of employing a microcomputer with lower capability as the sub controller, and ensuring higher safety than ever before. Signals indicating a combustion state of a combustion apparatus are inputted into the main controller 35 and the sub controller 36 in parallel. Upon fulfillment of a predetermined condition of stopping, the main and sub controllers 35 and 36 each output a stop signal to cut off a current to be supplied to a device driving circuit 42. The conditions of stopping in outputting of the stop signal by the main and sub controllers are such that the sub controller 36 is less apt to execute the cutoff than the main controller 35.

19 Claims, 5 Drawing Sheets

FOREIGN PATENT DOCUMENTS

| | | | | |
|---|---|---|---|---|
| EP | 0734550 | B1 | | 12/1994 |
| JP | 01-118061 | A | | 5/1989 |
| JP | 02-028735 | A | | 1/1990 |
| JP | 02-230458 | A | | 9/1990 |
| JP | 2002-257339 | A | | 9/2002 |
| JP | 2002257339 | A | * | 9/2002 |
| JP | 2002-318003 | A | | 10/2002 |
| JP | 2002-257339 | | * | 11/2002 |
| WO | WO-95/16943 | A1 | | 6/1995 |

OTHER PUBLICATIONS

International Search Report.

* cited by examiner

COMBUSTION CONTROL DEVICE

BACKGROUND OF THE INVENTION

1. Field of the Invention

The present invention relates to a control device for a combustion apparatus. The present invention is suitable for a control device for combustion apparatus provided with a hot water supply function.

2. Description of Related Art

Combustion apparatus as typified as a gas water heater has a control device equipped in its controlling center with a microcomputer, whereby operational control on various actuators such as a gas solenoid valve for switching supply/stop of fuel gas, a proportional valve for adjusting fuel gas supply, a fan motor for adjusting combustion air blow.

Thus, if and when the microcomputer runs out of control, fuel gas supply or air blow goes out of control, resulting in excessive combustion or accidental extinction. Further, that might cause a fan out of control, resulting in deterioration of a combustion state due to disproportion of air-fuel ratio. Therefore, a means for dealing with such a problem is disclosed in a patent document 1.

A control device disclosed in the patent document 1 incorporates two microcomputers and prevents the microcomputers from running out of control by monitoring their operations each other by communication between the microcomputers.

Patent documents 2 and 3 also disclose inventions whereby a plurality of computers monitor each other, though not relating to a combustion apparatus.

Patent Document 1: JP 2002-318003A
Patent Document 2: JP 02-28735A
Patent Document 3: JP 02-230458A

SUMMARY OF THE INVENTION

Problems to be Solved by the Invention

The control device disclosed in the above-mentioned patent document 1 installs a main microcomputer and a sub microcomputer therein, the former performing central control, the latter performing secondary control. Thus, details to be controlled by the main microcomputer or those to be controlled by the sub microcomputer depend on an application or a model of a combustion apparatus, and whereby capability of a microcomputer to be installed is selected.

High capability could be required for a microcomputer to be selected as a sub microcomputer, resulting in a problem of low degree of compatibility of components.

Further, safety is naturally required for a combustion apparatus, and recently, higher safety is required than ever before. That is why potential dangerous situation such as a too large flame formation, an accidental extinction during fuel injection, or supply of extraordinary high-temperature water from a water heater should be prevented by taking double or triple defensive measures.

From that point of view, the controller described in the patent document 1 leaves problems to be improved. Specifically, according to a configuration in the patent document 1, the sub microcomputer enables to bring down the combustion apparatus in the case of failure of the main microcomputer, but does not have in itself a function of anomaly detection of the combustion apparatus. Therefore, combustion might not be stopped though it should be brought to an emergency stop in the case that the main microcomputer has generated a slight failure that does not lead it out of control but results in misdetection of various signals.

The techniques disclosed in the patent documents 2 and 3 only monitor a microcomputer running out of control.

An object of the present invention made in view of the problems and drawbacks in the art described above is therefore to provide a combustion control device capable of employing a sub microcomputer with lower capability and ensuring higher safety than ever before.

Means to Solve the Problem

In order to achieve the object described above, an aspect of the present invention provided herein is a combustion control device for a combustion apparatus including a main controller and a sub controller, the main controller being adapted to be in charge of overall control of the combustion apparatus and to execute cutoff for cutting off fuel supply, and the sub controller being adapted to execute cutoff of fuel supply independently of the main controller, wherein the main and sub controllers are each adapted to receive at least one signal indicating an operational state of the combustion apparatus, so as to execute emergency cutoff when the signal meets a predetermined condition of stopping, and wherein the conditions of stopping by the main and sub controllers are such that the sub controller is less apt to execute the cutoff than the main controller.

The combustion control device in the present aspect definitely distinguishes between functions of the main controller and of the sub controller, the main controller being in charge of overall control of a combustion apparatus. Thus, a capability required for the sub controller is relatively low, so that selection of a device employed as the sub controller is expanded.

Further, in the present aspect, not only the main controller but also the sub controller executes emergency cutoff upon fulfillment of a predetermined condition of stopping, so that fuel supply is cut off certainly even if there is a problem with either one of them.

Still further, such a problem that combustion stops by mistake during a normal operation is not caused because the conditions of stopping by the main and sub controllers are such that the sub controller is less apt to execute the cutoff than the main controller.

Recently, since a combustion apparatus performs combustion under various conditions of combustion, combustion level may be increased or air-blow rate may be increased or decreased for a short period of time. Such a case is recovered in a short period of time, being neither an anomalous combustion nor a dangerous situation. Therefore, such a setting or a program that a device does not stop by fluctuation in the anticipated range is often configured with the main controller. Thus, if a threshold to determine an anomaly by the sub controller is lower (in such a manner as determining as an anomaly more easily) than that by the main controller, emergency cutoff is frequently executed when combustion is not expected to stop, resulting in being more inconvenient.

On the other hand, the sub controller might install therein a program similar to that in the main controller, but installation of the program similar to that in the main controller makes their anomaly criteria similar to each other, resulting in such an unsteady state as being uncertain which should detect an anomaly on ahead to perform cutoff due to fluctuation of detecting operations by the main and sub controllers. That is undesirable.

In addition, such a measure as installing in the sub controller the same program as the main controller is against the above-mentioned purpose to degrade a capability required for the sub controller.

Further, there is actually such a case as requiring providing in with a dedicated combustion apparatus having conditions such as anomaly criteria depending on a model of the combustion apparatus in each model. In this case, the main controller needs a hardware or software suitable to the model, but the sub controller may be generally applied to different models of combustion apparatus by making conditions of stopping by the main and sub controllers such that the sub controller is less apt to execute the cutoff than the main controller.

The present aspect therefore makes the conditions of stopping by the main and sub controllers such that the sub controller is less apt to execute the cutoff than the main controller, so as to restrict the cutoff by the sub controller, balancing improvement of security with improvement of compatibility.

Herein, the number of "signals indicating an operational state of a combustion apparatus" inputted into the main controller does not always correspond to that of "signals indicating an operational state of a combustion apparatus" inputted into the sub controller. In the case that ten sensors are attached to a combustion apparatus, for example, signals from the ten sensors are preferably inputted into both of the main and sub controllers, but signals from the ten sensors into the main controller and signals from eight sensors into the sub controller may be inputted. Further, sensors having the same function are attached to adjacent sites, a signal from one sensor into the main controller and a signal from the other sensor into the sub controller may be inputted.

It is possible that the combustion apparatus incorporating the combustion control device is for heating liquid and that each of the conditions of stopping is that temperature of the liquid exceeds or even equals to a predetermined value.

This configuration is assumed so as to incorporate the above-mentioned aspect in a water heater. The present aspect executes cutoff when temperature of the liquid exceeds or even equals to a predetermined value, achieving high security.

Each of the conditions of stopping is preferably that an anomaly of a combustion state and/or a cause of an anomaly of a combustion state are detected.

In the present aspect, the cause of an anomaly of a combustion state includes such a situation that an air-blow rate or the rotation number of a fan is out of a predetermined range, the situation continuing for a predetermined period of time. The cause also includes such a situation that opening degree of a valve such as a proportional valve for controlling a combustion amount is out of a predetermined range, the situation continuing for a predetermined period of time. The cause also includes such a situation that temperature of a flame or a specific part of a device is out of a predetermined range, the situation continuing for a predetermined period of time.

Herein, the embodiment uses terms an "anomaly" and a "danger", but the term "anomaly" has a broader concept than the term "danger" and thus, a dangerous situation (viz. danger) naturally means an anomaly.

It is recommended that the main and sub controllers are each adapted to receive at least one of the following signals:

(1) a detection signal from a flame detector for detecting flame;
(2) a rotation number detection signal from a fan;
(3) a detection signal from a flame temperature detector for measuring flame temperature;
(4) an actuating signal from a fuel control valve for controlling fuel supply; and
(5) a detection signal from a device temperature detector for measuring temperature of any part in the combustion apparatus.

These signals are important as signals indicating a combustion state.

It is preferable that the combustion apparatus is for heating water and that the main and sub controllers are each adapted to receive at least one of the following signals:

(1) a detection signal from a water flow rate detector for measuring water flow rate;
(2) a detection signal from a water flow detector for detecting flowing water;
(3) a detection signal from a supplied hot-water temperature detector for measuring hot-water temperature supplied from the combustion apparatus; and
(4) a detection signal from a water temperature detector for measuring water temperature at any part in the combustion apparatus.

These signals are important as signals indicating an operational state of a water heater.

It is preferable that the combustion apparatus includes a solenoid valve normally closed and adapted to intermittently supply fuel and a flame detector adapted to detect existence or nonexistence of flame and that the combustion apparatus is for heating water and further includes a water flow detector for detecting existence or nonexistence of flowing water, so that at least one of the main and sub controllers executes the cutoff upon fulfillment of the predetermined condition of stopping on the basis of conditions that the solenoid valve is energized, that the flame detector detects flame, and that the water flow detector detects flowing water.

The combustion control device in the present aspect executes cutoff only if the above-mentioned conditions are met regardless of actual occurrence of combustion. That decreases the risk of erroneous determination on existence of combustion and due to a failure of the control device.

It is preferable to employ such a configuration that at least one of the main and sub controllers is adapted to execute the cutoff in the case that difference between signals inputted to the main and sub controllers from the same signal source exceeds a certain level, with the signals being compared with each other.

Recently, a combustion control device has been miniaturized with an extremely thin internal wiring. That often results in a wire breaking or a bad electrical contact inside. The present aspect therefore detects such a failure as a wire breaking by comparing signals inputted to the main and sub controllers from the same signal source.

Specifically, the signals inputted to the main and sub controllers from the same signal source should be normally identical with each other, and thus some anomaly is suspected if the both signals greatly differ from each other. The present aspect therefore compares the signals inputted to the main and sub controllers from the same signal source, so as to cut off fuel supply in the case that difference between the both signals exceeds a certain level.

Further, it is preferable to employ such a configuration that the main and sub controllers are adapted to alternately execute the cutoff for stopping combustion at normal times, while one of the controllers not executing the cutoff is adapted to check a stop of fuel supply.

In the control device for a combustion apparatus in the present aspect, the main and sub controllers alternately execute a combustion stopping action normally performed by a controller, and one of the controllers not executing the cutoff checks stopping of combustion, so that whether the combustion stopping action by the sub controller is normally executed during a normal hot-water supplying operation is periodically checked. Consequently, when an anomaly occurs in the main controller, the sub controller stops combustion certainly.

Herein, "the main and sub controllers alternately execute the cutoff" preferably means to alternately execute the cutoff by the main and sub controllers each time in such a manner that the sub controller executes cutoff after the main controller executes cutoff, whereupon the main controller executes cutoff after the sub controller executes cutoff, but it is possible to employ such an irregular way that one of the controllers executes cutoff once in succession to executions of cutoff twice by the other controller.

Another aspect of the invention that has more specified constituents is a combustion control device for a combustion apparatus including a main controller and a sub controller, the main controller including a combustion controlling means adapted to control operations of the combustion apparatus under normal conditions, a signal input part to which a signal from a sensor attached to the combustion apparatus is to be inputted, an anomaly determining means adapted to determine an anomaly based on a control state of the combustion apparatus and the signal inputted to the signal input part, a stop signal output part adapted to output a stop signal for deactivating a predetermined function of an equipment upon determination of the anomaly by the anomaly determining function, a main controller condition storing part that stores conditions whereby the anomaly determining means determines an anomaly, and a main controller communicating part adapted to transmit data owned by the main controller to the sub controller, and the sub controller including a signal input part to which a signal from a sensor attached to the combustion apparatus is to be inputted, an anomaly determining means adapted to determine an anomaly based on the data transmitted from the main controller and the signal inputted to the signal input part, a stop signal output part adapted to output a stop signal for deactivating a predetermined function of an equipment upon determination of the anomaly by the anomaly determining means, a sub controller condition storing part that stores conditions whereby the anomaly determining function determines an anomaly, and a sub controller communicating part adapted to receive data transmitted from the main controller, wherein the conditions of determining an anomaly stored in the main and sub controller condition storing parts are such that the sub controller is less apt to determine an anomaly than the main controller.

Still another aspect similarly putting the components into shape is a combustion control device for a combustion apparatus, including a main controller and a sub controller, the main controller including a combustion controlling means adapted to control operations of the combustion apparatus under normal conditions, a signal input part to which a signal from a sensor attached to the combustion apparatus is to be inputted, an anomaly determining means adapted to determine an anomaly based on a control state of the combustion apparatus and the signal inputted to the signal input part, a stop signal output part adapted to output a stop signal for deactivating a predetermined function of an equipment upon determination of the anomaly by the anomaly determining means, a main controller condition storing part that stores conditions whereby the stop signal output part outputs a stop signal, and a main controller communicating part adapted to transmit sensor detection data detected by the main controller to the sub controller and receive sensor detection data detected by the sub controller, and the sub controller including a signal input part to which a signal from a sensor attached to the combustion apparatus is to be inputted, an anomaly determining means adapted to determine an anomaly based on the data transmitted from the main controller and the signal inputted to the signal input part, a stop signal output part adapted to output a stop signal for deactivating a predetermined function of an equipment upon determination of the anomaly by the anomaly determining means; a sub controller condition storing part that stores conditions whereby the stop signal output part outputs a stop signal, and a sub controller communicating part adapted to transmit data detected by the sub controller and receive sensor detection data detected by the main controller, wherein the conditions of determining an anomaly stored in the main and sub controller condition storing parts are such that the sub controller is less apt to determine an anomaly than the main controller.

The above-mentioned aspects each have the function to execute emergency cutoff by both of the main and sub controllers, but the main controller is preferably reset when the sub controller executes the emergency cutoff.

Since the conditions of stopping by the main and sub controllers are such that the sub controller is less apt to execute the cutoff than the main controller, the main controller is supposed to have some anomaly in the case that the sub controller determines to carry out the cutoff. The present aspect therefore not only cuts off fuel supply but also stops the main controller in the case that the sub controller detects a predetermined condition of stopping.

Herein, the main controller is preferably automatically rebooted. In an actual circuit, it is possible to employ such a measure that the sub controller transmits a reset signal for a predetermined period of time and thereafter releases the reset signal, so as to reboot the main controller.

A combustion apparatus incorporating the combustion control device as described above ensures an improved security.

Advantageous Effect of the Invention

The combustion control device in the present invention allows a sub microcomputer with lower capability to be employed, thereby improving the compatibility of components. Further, the control device for a combustion apparatus in the present invention ensures higher safety than ever before.

DESCRIPTION OF THE PREFERRED EMBODIMENT

Now, an embodiment of the present invention will be described below in detail, making reference to the accompanying drawings.

Figure 3:
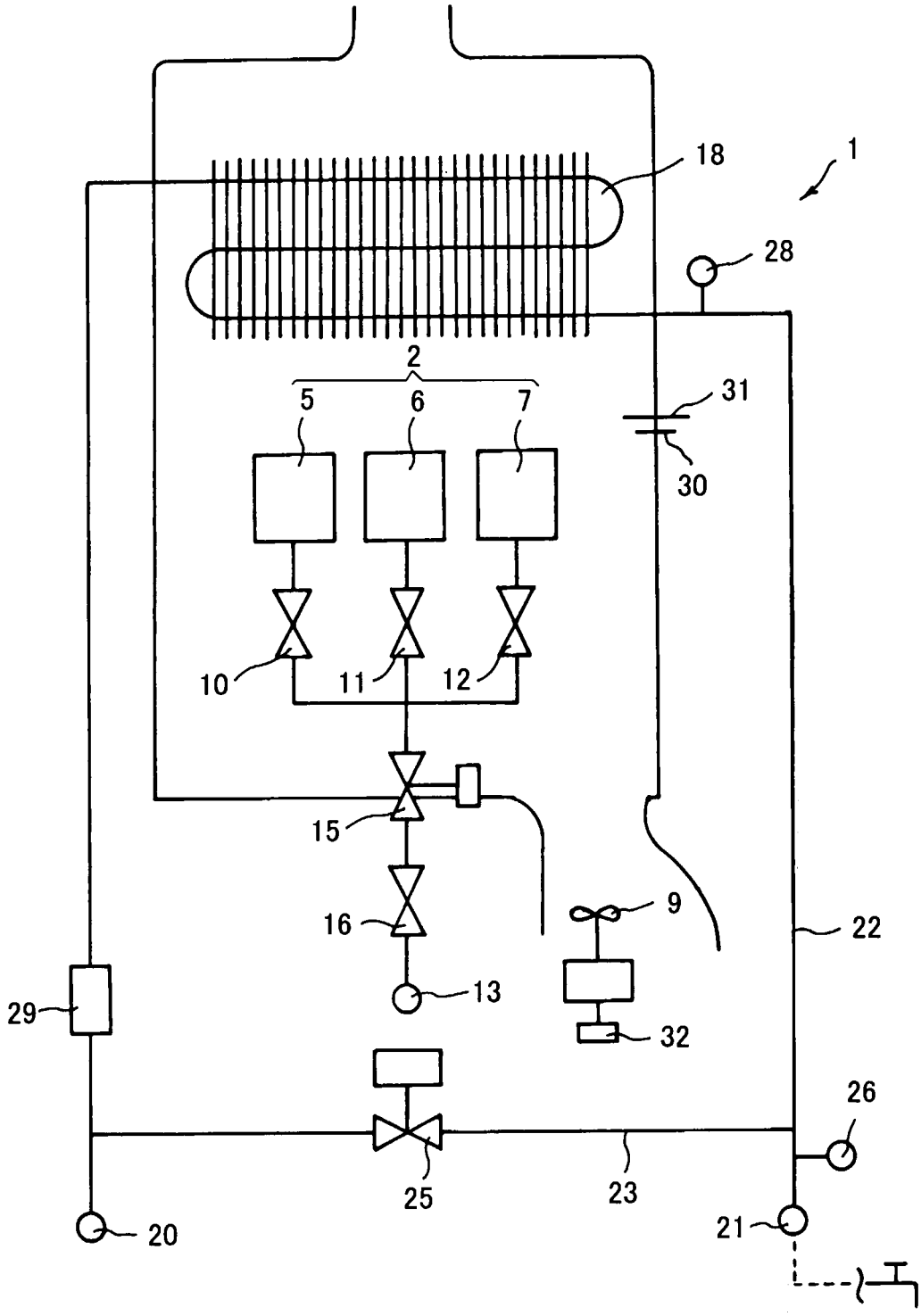
FIG. 3 is a schematic diagram of a water heater controlled by the control device in the present invention.

A combustion control device 27 in the present embodiment is used in a water heater 1 as shown in FIG. 3. The water heater 1 runs on gas, which is supplied to a burner group 2, so as to burn the gas. The water heater 1 in the present embodiment has three burners 5, 6, and 7 and gas solenoid valves 10, 11, and 12 located at their respective gas supply passages, respectively.

The gas supply passages are united into one passage to be connected to a gas supply source 13, a proportional valve 15 and a main solenoid valve 16 intervening therebetween. The gas solenoid valves 10, 11, and 12 and the main solenoid valve 16 are normally-closed valves and closed upon cutoff of electric current supply to solenoids.

The water heater 1 has a heat exchanger 18 and is for heating water in the heat exchanger 18 by flame generated in the burner group 2. Further, there is provided with a fan 9 for blowing air to the burner group 2.

Hot water flows through two circuits: a high-temperature water circuit 22 from a water supply source 20 through the heat exchanger 18 to a hot-water supplying part 21 and a bypass water passage 23 connected to the high-temperature water circuit 22 with bypassing the heat exchanger 18. The bypass water passage 23 has a water-supply regulating valve 25, whereby water supply flowing through the bypass water passage 23 is regulated to control temperature of hot water supplied through the hot-water supplying part 21.

Various kinds of sensors are positioned at the water heater 1. A water flow rate sensor 29 is positioned in the high-temperature water circuit 22. A temperature sensor 28 for high-temperature water is positioned adjacent to an exit of the heat exchanger 18 of the circuit 22 and a temperature sensor 26 for supplied hot-water is positioned at downstream of a connecting part of the circuit 22 with the bypass water passage 23.

A flame rod 30 and a burner sensor 31 are positioned adjacent to the burner group 2. The flame rod 30 is for detecting existence of flame and the burner sensor 31 is for measuring temperature of flame.

There is also provided with a rotation number detecting sensor 32 for measuring the rotation number of the fan 9.

Figure 1:
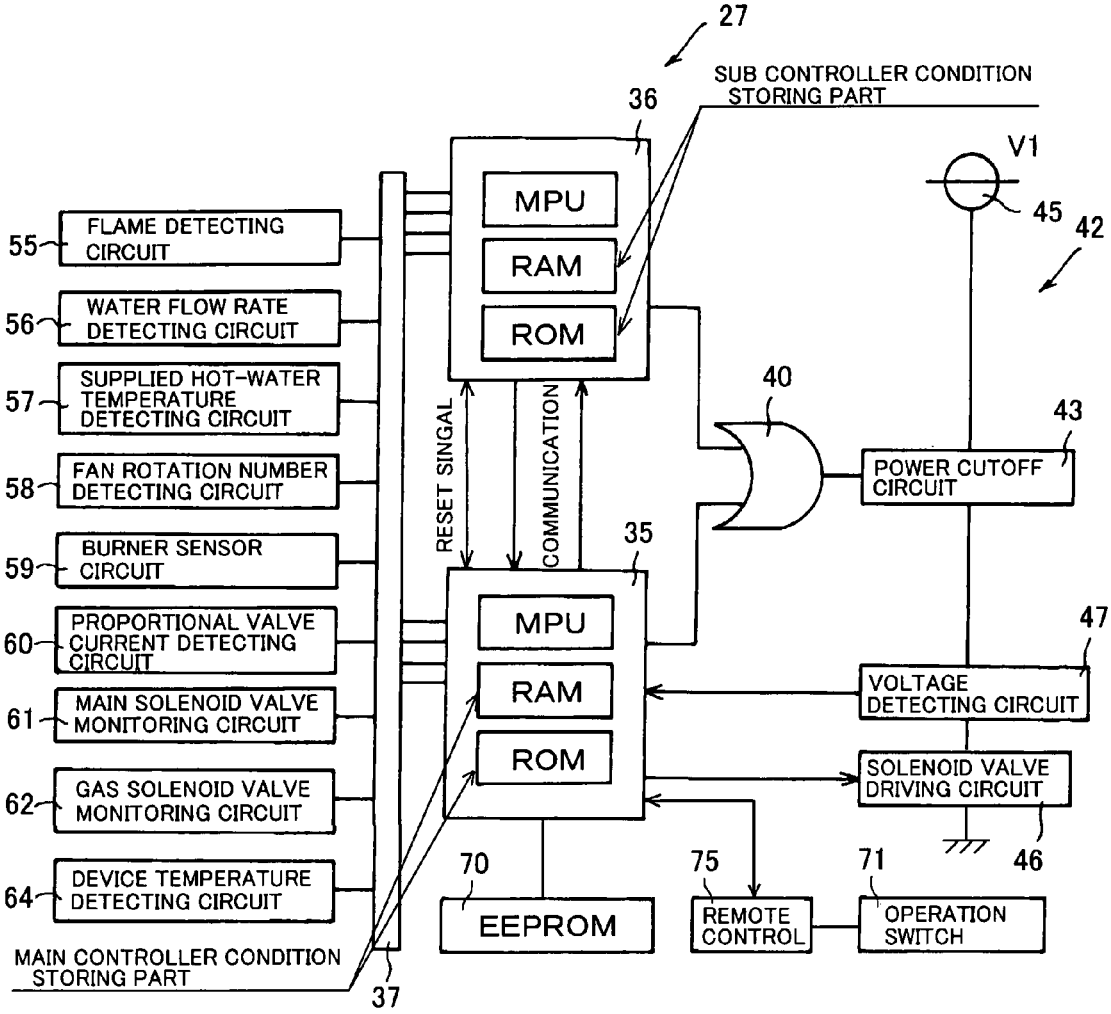
FIG. 1 is a circuit block diagram in using the combustion control device in the present invention as a control device for a water heater.

Next, a brief summary of the combustion control device 27 in the present embodiment will be described, making reference to FIG. 1. The combustion control device 27 has two microcomputers (controllers) 35 and 36, as shown in FIG. 1. The microcomputers 35 and 36 each are a discrete computer provided with an MPU, a RAM, and a ROM. There is also provided with an interface circuit (not shown) as well as the known microcomputer. However, one microcomputer 36 has a capability such as processing speed of a MPU and capacities of a RAM and a ROM inferior to the other microcomputer 35.

In the present embodiment, the microcomputer 35 having a higher capability performs functions as a main controller 35, whereas the microcomputer 36 having a lower capability performs functions as a sub controller 36.

The main controller 35 carries out a function similar to a controller incorporated in the known combustion control device and is in charge of main control of the combustion control device 27. Specifically, the main controller 35 is provided with a combustion controlling means for controlling operations of a combustion apparatus under normal conditions, and more specifically, the operations such as ignition to the burner group 2, and regulation of supplied hot-water temperature or gas, opening and closing of each solenoid valve, and control of the fan 9. Further, in the case that a remote control 75 is connected to the water heater 1, the main controller 35 communicates with the control 75 to receive various commands from the control 75, and also carries out an action such as transmission of an operational state of the water heater 1 to the control 75. The main controller 35 has all basic functions provided in a controller in the conventional gas water heater.

The remote control 75 has a push button (operating part) for an operation switch 71. When the push button for the operation switch 71 is operated, the resulting signal is transmitted via the control 75 to the main controller 35, thereby switching operation modes.

The main controller 35 is provided with an anomaly determining means for determining an anomaly based on information such as control signals outputted from itself, a control state of the combustion apparatus, or signals inputted to the signal input part from a part such as each sensor, since the main controller 35 carries out functions similar to a controller incorporated in the known combustion control device as described above. Upon determination of an anomaly, emergency cutoff is executed.

The RAM or the ROM in the main controller 35 stores conditions of determining either an anomaly or not. Thereby, in the present embodiment, the RAM or the ROM in the main controller 35 functions as a main controller condition storing part.

In contrast, the sub controller 36 carries out only cutoff for cutting off fuel supply. Specifically, the sub controller 36 controls only opening and closing of the main solenoid valve 16 and the gas solenoid valves 10, 11, and 12.

The sub controller 36 is also provided with an anomaly determining means for determining an anomaly based on information such as signals inputted to the signal input part from the part such as each sensor. Upon determination of an anomaly, emergency cutoff is executed. The RAM or the ROM in the sub controller 36 stores conditions of determining either an anomaly or not, functioning as a sub controller condition storing part.

As described below, the conditions of determining an anomaly stored in the main and sub controller condition storing parts are such that the sub controller is less apt to determine an anomaly than the main controller.

The two controllers 35 and 36 have communicating parts 63 and 65 for bidirectional data communication, respectively. Specifically, the main controller 35 has the main controller communicating part 63 for transmitting data owned by the main controller 35 to the sub controller 36, whereas the sub controller 36 has the sub controller communicating part 65 for transmitting data owned by the sub controller 36 to the main controller 35.

The communicating parts 63 and 65 each have a communicating terminal (not shown). The terminals are connected through an interface (communicating means) to a microprocessor (MPU) or a memory of the main controller 35 via a bus, and whereby data is transmitted and received between the microprocessor of the main controller 35 and a microprocessor of the sub controller 36.

Further, the two controllers 35 and 36 each output a reset signal to the other. The main controller 35 outputs the reset signal to the sub controller 36, whereupon the sub controller 36 having received the reset signal executes stop and restart.

In contrast, the sub controller 36 outputs the reset signal to the main controller 35, whereupon the main controller 35 having received the reset signal executes stop and restart.

Still further, a nonvolatile storage element 70 is connected to the main controller 35. The nonvolatile storage element 70 is an EEPROM.

The main and sub controllers 35 and 36 are connected via a bus line 37 to a flame detecting circuit 55, a water flow rate detecting circuit 56, a supplied hot-water temperature detecting circuit 57, a fan rotation number detecting circuit 58, a burner sensor circuit 59, a proportional valve current detecting circuit 60, a main solenoid valve monitoring circuit 61, a gas solenoid valve monitoring circuit 62, and a device temperature detecting circuit 64 so as to transmit signals indicating an operational state of the combustion apparatus. The device temperature detecting circuit 64 is connected to device temperature sensors 33 positioned on some parts in the combustion apparatus.

Therefore, a signal from the part such as each sensor is inputted to both of the main controller 35 and the sub controller 36 in parallel.

Figure 2:
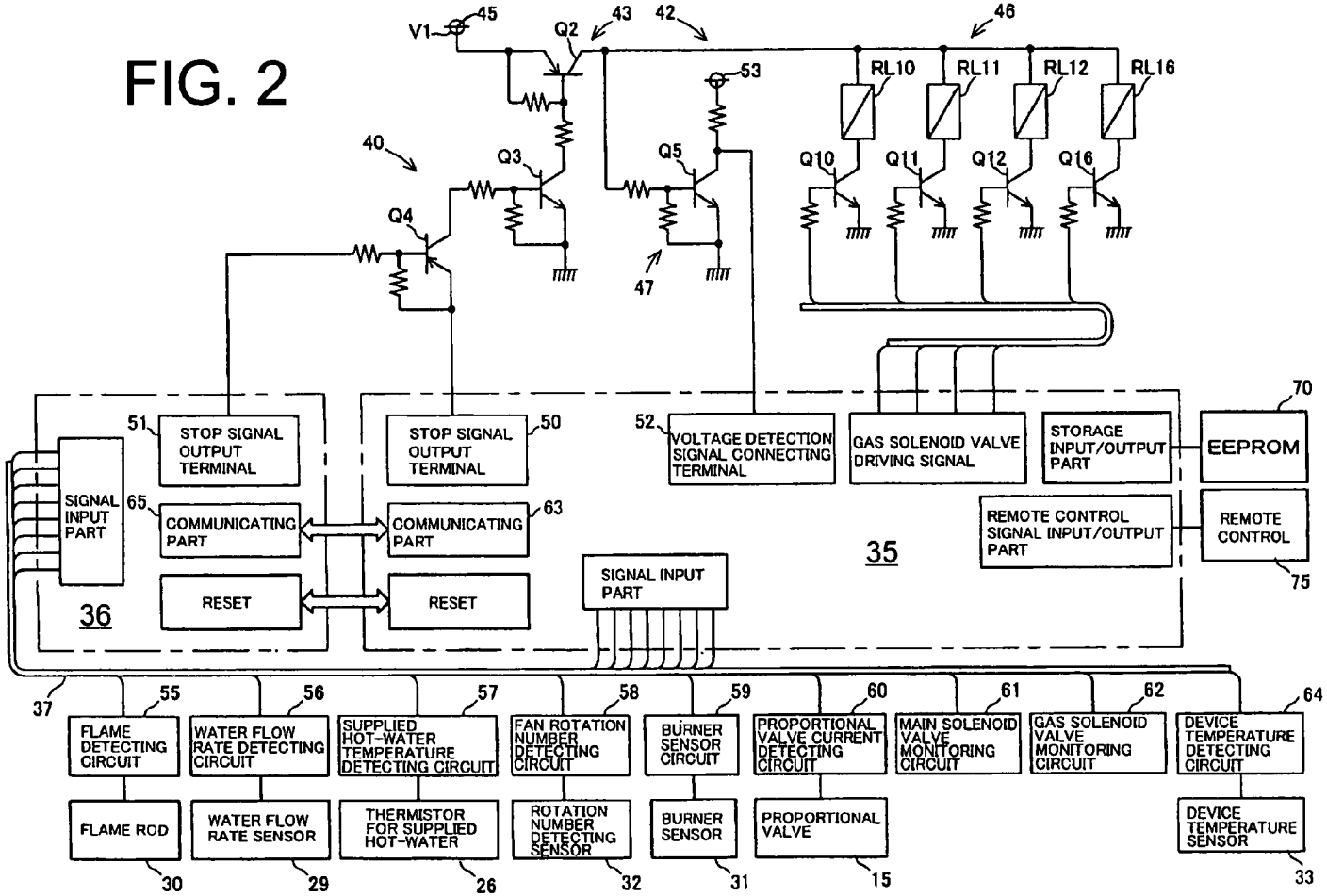
FIG. 2 is a circuit diagram in using the combustion control device in the present invention as a control device for a water heater.
Figure 5:
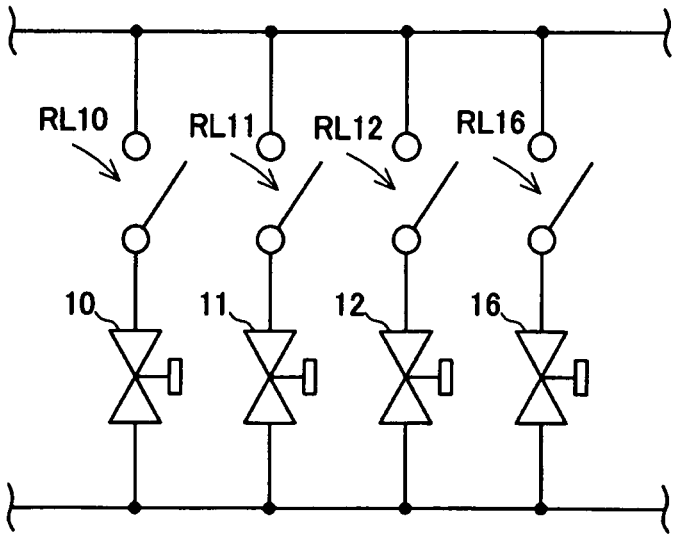
FIG. 5 is a circuit diagram showing relation of connection between solenoid valves in FIG. 2.

The combustion control device 27 in the present embodiment further includes a device driving circuit 42 for supplying an electric power from a power source V1 to a solenoid valve driving circuit 46. In the present embodiment, the device driving circuit 42 is a power-supply line for operating a fuel supply system, being divided into two lines consisting of a line for supplying an electric power to coils in relays for operating the respective solenoid valves as shown in FIG. 2 and a line for supplying an electric power to solenoids of the respective solenoid valves themselves as shown in FIG. 5. In either line, cutoff of the electricity flowing through the circuit closes the solenoid valves, thereby cutting off fuel to be supplied to the burner group 2. That stops combustion if combustion exists and prevents start of combustion if no combustion exists.

The main and sub controllers 35 and 36 each output a power cutoff signal, which is inputted to an OR circuit 40. The OR circuit 40 transmits the signal through the device driving circuit 42 to a power cutoff circuit 43.

Herein, the power cutoff circuit 43 is interposed in a line between a driving power source 45 and the solenoid valve driving circuit 46, and is supposed to cut off voltage applied to the main solenoid valve 16 and the gas solenoid valves 10, 11, and 12.

Since the main solenoid valve 16 and the gas solenoid valves 10, 11, and 12 are normally closed as described above, each solenoid valve is closed to stop supplying gas to the burner group 2 by cutting off the applied voltage to each solenoid valve by operation of the power cutoff circuit 43.

Further, a voltage detecting circuit 47 is interposed between the power cutoff circuit 43 and the solenoid valve driving circuit 46, so that signals from the voltage detecting circuit 47 are inputted to the main controller 35.

As described above, a power cutoff signal outputted from the main and sub controllers 35 and 36 is inputted to the power cutoff circuit 43 via the OR circuit 40, so that the power cutoff circuit 43 is operated to cut off voltage applied to each solenoid valve on the basis of the output of the power cutoff signal from the main or sub controller 35 or 36, thereby stopping supplying gas to the burner group 2.

Whether an electrical current from the driving power source 45 is cut off or not is determined by checking a signal from the voltage detecting circuit 47 by the main controller 35. Specifically, the voltage detecting circuit 47 is a circuit for determining whether an electric current is supplied to the solenoid valve driving circuit 46 or not, and simultaneously a circuit for indirectly checking whether fuel is supplied to the burner group 2 or not (cutoff checking means).

Whether an electric current flows through each solenoid valve or not is determined by checking signals from the main solenoid valve monitoring circuit and the gas solenoid valve monitoring circuit by the main and sub controllers 35 and 36.

The summary configuration of the control device 27 is described above using the block diagram, but the actual circuit is as shown in FIG. 2. Specifically, the main and sub controllers 35 and 36 have stop signal output terminals 50 and 51, respectively. The stop signal output terminals 50 and 51 each function as a stop signal output part.

Herein, the stop signal output terminal 50 of the main controller 35 outputs a Hi signal during normal operation of the water heater 1 and outputs a Lo signal upon detection of an anomaly.

In contrast, the stop signal output terminal 51 of the sub controller 36 is Lo during normal operation of the water heater 1 and becomes open upon detection of an anomaly.

The device driving circuit 42 is a circuit for supplying an electric current to the coil of each of the relays RL10, RL11, RL12, and RL16 from the driving power source V1 shown in FIG. 2. The device driving circuit 42 includes the solenoid valve driving circuit 46.

The solenoid valve driving circuit 46 is a circuit for controlling energization to the gas solenoid valves 10, 11, and 12 and the main solenoid valve 16, and as shown in FIG. 2, mainly consists of the coils in the relays RL10, RL11, RL12, and RL16 and transistors Q10, Q11, Q12, and Q16 for driving control of these relays RL10, RL11, RL12, and RL16. Herein, the numeral of each relay corresponds to the numeral of each solenoid valve. A contact of each relay RL10, RL11, RL12, or RL16 becomes closed by energization to the respective coil.

The main controller 35 transmits a relay driving signal to base terminals of the transistors Q10, Q11, Q12, and Q16. The relay driving signal inputted from the main controller 35 turns on each of the transistors Q10, Q11, Q12, and Q16 to supply an electric current to each of the relays RL10, RL11, RL12, and RL16, and whereby the relay contacts (FIG. 5) are operated to energize the solenoids of the gas solenoid valves 10, 11, and 12 and the main solenoid valve 16. Each solenoid valve is open by the energization to the solenoid as being normally closed as described above. Therefore, energization to each of the relays RL10, RL11, RL12, and RL16 operates its relay contact, which is serially connected to the coil of each solenoid valve relative to a power source for the gas solenoid valves, so that an electric current is supplied to the coil of each solenoid valve to open each solenoid valve.

The power cutoff circuit 43 is a circuit for cutting off an electric current to the device driving circuit 42, and more specifically, a circuit capable of cutting off the power supplied to each of the relays RL10, RL11, RL12, and RL16 all at once. In the present embodiment, the power cutoff circuit 43 consists mainly of a transistor Q2 interposed between the driving power source V1 for the relays RL10, RL11, RL12, and RL16 and the relays. Specifically, the transistor Q2 is a PNP transistor with its emitter terminal connected to the power source V1 and its collector terminal connected to ends of the relays RL10, RL11, RL12, and RL16. The power cutoff signal inputted to the base terminals turns off the transistor Q2 to cut off voltage applied to each relay.

Further, the present embodiment is constituted in such a manner that a collector terminal of a transistor Q3 is connected to the base terminal of the transistor Q2 constituting the power cutoff circuit 43 so that turning off of the transistor Q3 turns off the transistor Q2. That is, turning off of the transistor Q3 inputs a power cutoff signal to the transistor Q2.

The OR circuit 40 shown in FIG. 1 consists mainly of the transistor Q3 and a transistor Q4. The transistors Q3 and Q4 are positioned among the main and sub controllers 35 and 36 and the transistor Q2 constituting the power cutoff circuit 43. The stop signal output terminal 50 of the main controller 35 is connected to an emitter terminal of the transistor (PNP type) Q4, while the stop signal output terminal 51 of the sub controller 36 is connected to a base terminal of the transistor Q4.

A collector terminal of the transistor (PNP type) Q4 is connected to a base terminal of the transistor (NPN type) Q3.

Further, an emitter terminal of the transistor (NPN type) Q3 is grounded.

As described above, the stop signal output terminal 50 of the main controller 35 outputs a Hi signal during normal operation of the water heater 1 and a Lo signal (Lo active signal) upon detection of an anomaly, whereas the stop signal output terminal 51 of the sub-controller 36 is Lo during normal operation of the water heater 1 and becomes open upon detection of an anomaly. Thereby, during normal operation of the water heater 1, the transistor (PNP type) Q4 is turned on with its base coming into Lo, resulting in making the emitter of the transistor (PNP type) Q4 H. Consequently, during normal operation of the water heater 1, the transistor Q4 is turned on to turn on the transistor Q3, which also turns on the transistor Q2, so that the device driving circuit 42 is energized so that an electric current is supplied to the relays RL10, RL11, RL12, and RL16 to make it possible to open each solenoid valve.

In the circuit shown in FIG. 1, the relays RL10, RL11, RL12, and RL16 disposed at the driving circuits of the gas solenoid valves 10, 11, and 12 and the main solenoid valve 16 are all independently openable and closable by signals from the main controller 35. Thus, during normal operation of the water heater 1, the device driving circuit 42 is energized, thereby magnetizing the coil of each of the relays RL10, RL11, RL12, and RL16 to connect its contact upon reception of the signals from the main controller 35, so as to open each of the solenoid valves 10, 11, 12, and 16.

On the other hand, upon detection of a condition of stopping, the main or the sub controller 35 or 36 cuts off energization of the device driving circuit 42. Specifically, the transistor (PNP type) Q4 is turned off to turn off the transistors Q3 and Q2, so that the current to be supplied to each of the relays RL10, RL11, RL12, and RL16 is cut off.

Specifically, when the main controller 35 detects an anomaly or a dangerous condition or its cause, the stop signal output terminal 50 comes into Lo to make the base of the transistor Q3 Lo, so that the transistor Q3 is turned off. That makes the transistor Q2 turned off, so that the current to be supplied to each of the relays RL10, RL11, RL12 and RL16 is cut off.

Further, when the sub controller 36 detects the condition of stopping, the sub controller 36 cuts off a current to the device driving circuit 42 as well. Specifically, the stop signal output terminal 51 becomes open to open the base of the transistor Q4, thereby turning off the transistor Q4. That turns off the transistors Q3 and Q2, so that the current to be supplied to each of the relays RL10, RL11, RL12, and RL16 is cut off.

The voltage detecting circuit (cutoff checking means) 47 is constituted by a transistor (NPN type) Q5.

A supply line from the driving power source V1 is branched in parallel at downstream of the transistor Q2 and connected to a base terminal of the transistor (NPN type) Q5. A collector terminal of the transistor (NPN type) Q5 is connected to a voltage detection signal connecting terminal 52 of the main controller 35, and also to a power source 53 of low voltage via a resistor.

An emitter terminal of the transistor (NPN type) Q5 is grounded.

An electric current flows through the base of the transistor (NPN type) Q5 upon turning on the supply line from the power source V1, thereby turning on the transistor Q5, which makes the voltage detection signal connecting terminal 52 of the main controller 35 into Lo.

In contrast, when the supply line of the power source V1 is turned off, an electric current is not supplied to the base of the transistor (NPN type) Q5, resulting in turning off the transistor Q5, which applies low voltage to the voltage detection signal connecting terminal 52 of the main controller 35.

The main solenoid valve monitoring circuit 61 and the gas solenoid valve monitoring circuit 62 respectively detect whether the main solenoid valve and the gas solenoid valves are open or closed by monitoring of the driving voltage supplied to these valves, outputting valve monitoring signals when the main solenoid valve 16 and/or the gas solenoid valves 10, 11, and 12 are open. Specifically, the gas solenoid monitoring circuit 62 is constituted by a circuit for monitoring voltage applied to the both sides of the coils of the gas solenoid valves 10, 11, and 12. Herein, it is enough if the gas solenoid valve monitoring circuit 62 can detect only whether the solenoid valves are open or close, and thus, it is possible to employ such another configuration as monitoring a current supplied to the coils, for example.

Further, the flame detecting circuit 55 detects whether combustion takes place or not by means of the flame rod 30 arranged adjacent to the burners 5, 6, and 7 and outputs a flame detection signal when combustion takes place. Further, the water flow rate detecting circuit 56 measures the water flow rate based on a signal sensed by the water flow rate sensor 29 positioned at upstream of the heat exchanger 18 and outputs a water flow detection signal when the water flow rate exceeds a minimum operating quantity of water. In this case, the water flow rate sensor 29 and the water flow rate detecting circuit 56 each functions as a water flow detector for detecting existence or nonexistence of water flow, but the water flow rate detecting circuit 56 may continuously vary its output depending on the water flow rate. In this case, the water flow rate sensor 29 and the water flow rate detecting circuit 56 functions as a water flow rate detector for measuring the water flow rate.

Herein, the water flow rate detector and the water flow detector may be separately provided.

The supplied hot-water temperature detecting circuit 57 is a circuit for measuring temperature of hot tap water lastly run out of a water outlet by signals from the temperature sensor 26 for supplied hot-water. The burner sensor circuit 59 is a circuit for measuring temperature of flame by signals from the burner sensor 31. The proportional valve current detecting circuit 60 is a circuit for detecting electrical signals inputted to the proportional valve so as to measure opening degree of the proportional valve.

The fan rotation number detecting circuit 58 is a circuit for measuring the rotation number of the fan 9 by signals from the rotation number detecting sensor 32.

Next, a function of the combustion control device in the present embodiment will be described below.

The present embodiment employs the main and sub controllers 35 and 36 as controlling means for the water heater 1. The main controller 35 controls operation of each part of the water heater including opening and closing of the solenoid valves, and the sub controller 36 controls only opening and closing of the main solenoid valve 16 and the gas solenoid valves 10, 11, and 12.

Since the combustion control device 27 in the present embodiment is characterized in opening and closing control of the main control valve 16 and the gas solenoid valves 10, 11, and 12, the description puts emphasis on this point.

The main solenoid valve 16 and the gas solenoid valves 10, 11, and 12 are closed in the event of an anomaly of the water heater 1 or a dangerous operational state, but also naturally open and closed during normal operation of the water heater 1.

Thus, the main solenoid valve 16 and the gas solenoid valves 10, 11, and 12 are closed in the both cases when the water heater 1 is normally operating and has an anomaly, which are separately described.

First, opening and closing control of the main solenoid valve 16 and the gas solenoid valves 10, 11, and 12 during normal operation of the water heater 1 will be described below.

The combustion control device 27 in the present embodiment is constituted in such a manner that the sub controller 36 shares a combustion stopping action involved in a normal hot-water supplying operation among controls of every part of the water heater performed by the main controller 35.

Herein, the water heater 1 in this kind executes the combustion stopping action of the burners 5, 6, and 7 if it meets any of predetermined conditions during combustion in the burners 5, 6, and 7 such that a water flow rate of the heat exchanger 18 falls below a minimum operating quantity of water by an operation such as closing of a tap or that an off operation is done on an operating switch of the remote control in a normal hot-water supplying operation. As the conditions of stopping combustion in the normal operation themselves are well-known, a detailed description is omitted.

In the combustion control device 27 in the present embodiment, the two controllers 35 and 36 perform bidirectional data communications, so that a combustion stopping request during normal operation is transmitted from the main controller 35 to the sub controller 36.

In sharing the above-mentioned combustion stopping action, the sub controller 36 outputs a stop signal from the stop signal output terminal 51 upon reception of a command to execute a combustion stopping action given by the main controller 35 by means of the data communications. More specifically, the stop signal output terminal 51 is opened, so as to cut off an electric current to be supplied to each of the relays RL10, RL11, RL12, and RL16. In other words, an electric current to the device driving circuit 42 is cut off by the sub controller 36.

The main controller 35 installs therein a program for determining which of the main controller 35 and the sub controller 36 should execute the combustion stopping action in case of necessity of stopping combustion in the burners because of an operation such as closing of a tap. In the case of the combustion stopping action to be executed by the sub controller 36, the main controller 35 transmits the command to the sub controller 36 to execute the combustion stopping action.

Herein, the present embodiment sets this program such that the combustion stopping action is alternately executed by the main and sub controllers 35 and 36 each time in such a manner that the sub controller 36 executes an action after execution of an action by the main controller 35 and then the main controller 35 executes an action after execution of an action by the sub controller 36.

That is for confirming whether a stopping function normally works or not, the function including that of a circuit of a fuel control system such as the power cutoff circuit 43 or the solenoid valve driving circuit 46 by periodic execution of a combustion stopping action by a stopping output during normal hot-water supplying operation, and thus it is efficient to alternately execute an action by the main controller 35 and the sub controller 36 each time. Therefore, if it is within a scope of such a purpose, it is possible to employ such an irregular way that the sub controller 36 executes an action once after executions of actions twice in succession by the main controller 35. In short, a specific means to share the combustion stopping action may be altered appropriately only if it is capable of determining whether the combustion stopping function of the main controller 35 normally works or not. Further, it is also desirable to carry out ignition before combustion so as to confirm whether the main and sub controllers 35 and 36 normally work or not at that time.

In the case that the program determines to carry out a combustion stopping action by means of the main controller 35, its own control stops outputting the relay driving signal to close each solenoid valve, thereby carrying out the action.

Upon the combustion stopping action executed by either the main or the sub controller 35 or 36 in this way, the main controller 35 determines whether extinction is normally done or not, based on a valve monitoring signal from the solenoid valve monitoring circuits 61 and 62 (extinction detecting action). If it is not normally done, the following action stops combustion.

In the case that the combustion stopping action by the main controller 35 is not normally performed, the main controller 35 outputs a command of execution of a combustion stopping action to the sub controller 36 by communication, thereby making the sub controller to execute the action. Conversely, in the case that the combustion stopping action by the sub controller 36 is not normally performed, the main controller 35 stops outputting the relay driving signal, so as to execute the action.

As to sharing of the above-mentioned combustion stopping action, the main controller 35 records in memory a history relating to a combustion stopping action by the main controller 35 itself or a transmission of a command to the sub controller 36 to execute a combustion stopping action. Based on the resulting record, the above-mentioned alternating combustion stopping action is executed.

Next, a combustion stopping action in the event of an anomaly or of a dangerous operational state in the water heater 1 will be described below.

The combustion control device 27 in the present embodiment closes the main solenoid valve 16 and the gas solenoid valves 10, 11, and 12 when a predetermined condition of stopping is met. The combustion control device 27 in the present embodiment has various stopping conditions for increasing security, and thus, combustion is stopped not only when an anomaly happens in a combustion state or extremely high-temperature water is supplied but also when the cause of these states is detected.

An "anomaly" includes a leakage of unburned gas (unburned fuel) and no-water burning of a burner, for example. Specifically, such a case that a burner unit is not burning in spite of supply of fuel to the burner unit should be a leakage of unburned gas. In other words, such a case that flame is not detected in spite that the main solenoid valve 16 opens and at least one of the gas solenoid valves 10, 11, and 12 opens means a leakage of unburned gas. That means an anomaly.

Further, such a case that no water is supplied to a heat exchanger in spite that fuel is supplied to a burner unit and the burner unit is not burning should be no-water burning. In other words, such a case that water is not supplied at all or is supplied but below a minimum operating quantity of water (MOQ) for the water heater means a no-water burning. That means an anomaly.

Still further, such a case that the temperature sensor 26 for supplied hot-water measures such a high temperature as 90° C. or more may be dangerous of scald burn.

Yet further, such a case that the rotation number of the fan 9 is not increased may not be immediately dangerous, but this sate continuing for a predetermined period of time may cause anomalous combustion. Similarly, full open state of the proportional valve 15 continuing for a predetermined period of time or anomalous temperature of flame may be one of risks.

An anomaly is determined by signals from each sensor inputted into the main and sub controllers 35 and 36 or information and signals held in the main controller 35 itself. The information and the signals held in the main controller 35 itself are transmitted to the sub controller 36 by a communicating means, so that the sub controller 36 determines them by information transmitted from the main controller 35.

Since the signals sensed by a means such as each sensor and indicating an operational state of a combustion apparatus are inputted to the main and sub controllers 35 and 36 in parallel, the sub controller 36 determines an anomaly by using the signals directly received.

Each of the controllers 35 and 36 individually determines the situation as an anomaly or a danger. Herein, criteria for determination of the situation as an anomaly or a danger performed by the main controller 35 and by the sub controller 36 are different from each other.

Specifically, in the present embodiment, a threshold of determination performed by the sub controller 36 is higher than that by the main controller 35. In other words, the sub controller 36 determines the situation as an anomaly or a danger only when a situation with higher degree of an anomaly or a danger is detected. The criteria of the sub controller 36 are higher than those of the main controller 35 about within a range of 10 to 30%.

More specifically, when the temperature sensor 26 for supplied hot-water measures 85° C., the main controller 35 determines the situation as an anomaly, whereas the sub controller 36 determines the situation as an anomaly when the sensor 26 measures 90° C. The sub controller 36 does not output a stop signal at 85° C.

After such a situation that the burner sensor 31 measures more than 800° C. goes on for 150 seconds, the main controller 35 determines the situation as an anomaly and outputs a stop signal, but the sub controller 36 does not output a stop signal under this condition. The sub controller 36 determines the situation as an anomaly after such a situation described above goes on for 200 seconds.

Further, after such a situation that the rotation number of the fan 9 counts 1,000 rpm goes on for 10 seconds, the main controller 35 determines the situation as an anomaly, but the sub controller 36 determines as an anomaly after such a situation goes on for 20 seconds.

After such a situation that a value such as a current value of the proportional valve 15 is high or low goes on for 4 seconds, the main controller 35 determines the situation as an anomaly, but the sub controller 36 determines as an anomaly after such a situation goes on for 5 seconds.

The criteria to determine a situation as an anomaly or a danger by the sub controller 36 are, as described above, such that the sub controller is less apt to determine an anomaly than the main controller 35. Examples are explained as follows.

These include such a case that a value range, such as a temperature or the rotation number determined as a danger, differs between the two controllers 35 and 36 and the criteria of the latter are higher than those of the controller 35. For example, one determines the value range from 50 to 80 as a danger and the other determines the value range from 60 to 70 as a danger. A border line may differ between them like the value range of 80 or more or 90 or more. Further, there may be two dangerous ranges consisting of the higher value range and the lower value range, wherein the main controller 35 determines both of the ranges as a dangerous range and the sub controller 36 determines one of the ranges as a dangerous range. In other words, this is such a case as lack of one of the criteria.

Specifically, there is such a case that, as anomaly criteria by a temperature sensed by the temperature sensor, the main controller 35 has two criteria consisting of a high temperature criterion and a low temperature criterion and determines as an anomaly upon detection of either one of the criteria, but the sub controller 36 employs only the criterion of the high temperature, not using the criterion of the low temperature.

Further, items to be detected may differ between the two controllers 35 and 36.

For example, one of them determines a situation in which items A, B, C, and D get together as an anomaly, and the other of them determines a situation in which the items A, B, and C or the items A, B, C, D, and E get together as an anomaly. A combination of items may be replaced in such a manner that one employs a situation having A, B, C, and D and the other employs a situation having A, B, C, and E.

Still further, detection frequency may differ between the two controllers 35 and 36. For example, when some situation occurs 10 times within a predetermined period of time, the main controller 35 determines as a danger, and when the situation occurs 20 times, even the sub controller 36 determines as a danger.

Yet further, length of detection time may differ between the two controllers 35 and 36. For example, when some situation occurs for five consecutive seconds, the main controller 35 determines as a danger, and when the situation occurs for ten consecutive seconds, even the sub controller 36 determines as a danger.

Figure 4:
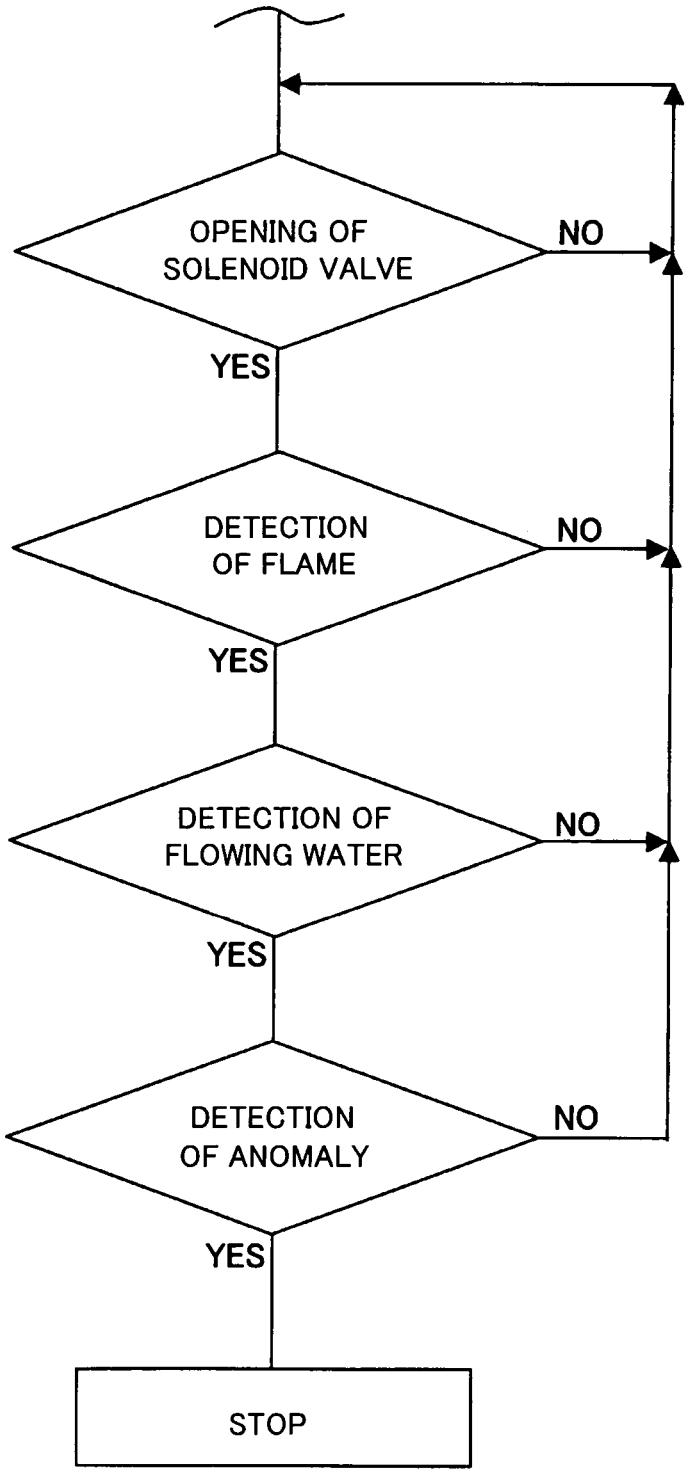
FIG. 4 is a flow chart showing a part of operations of the combustion control device shown in FIG. 1.

An extinction operation (cutoff operation) is executed immediately after the detection of an anomaly by the main or the sub controller 35 or 36. Specifically, a current supplied to the device driving circuit 42 is cut off. The extinction operation is executed on condition that combustion actually takes place, but in the present embodiment, as shown in FIG. 4, if conditions are met, the resulting situation is deemed to be combustion, the conditions being that a current is supplied to the normally closed solenoid valves 10, 11, 12, and 16 intermittently supplying fuel, that the flame detecting circuit 55 detects flame, and that the water flow rate detecting circuit 56 detects water flowing. Specifically, since the extinction operation is necessary to be executed even if the main controller 35 runs out of control, if a device faces the situation as described above, the situation is deemed to be combustion without waiting of determination of whether combustion actually takes place or not.

Herein, such a situation with unburned gas leaking is an exception and the extinction operation (cutoff operation) is executed when the flame detecting circuit 55 detects no flame.

When the main controller 35 detects an anomaly or a danger, the main controller 35 outputs a stop signal to close each of the solenoid valves 10, 11, 12, and 16. Specifically, upon detection of an anomaly by the main controller 35, a signal from the main controller 35 cuts off a current to be supplied to the device driving circuit 42. More specifically, the stop signal output terminal 50 of the main controller 35 comes into Lo to make the base of the transistor Q3 Lo, so that the transistor Q3 is turned off. That turns the transistor Q2 off, so that the current to be supplied to each of the relays RL10, RL11, RL12, and RL16 is cut off. As a consequence, the current to be supplied to each of the solenoid valves 10, 11, 12, and 16 is cut off, making each of the solenoid valves 10, 11, 12, and 16 closed, so that gas supply is stopped.

Further, whether the current to be supplied to each of the relays RL10, RL11, RL12, and RL16 is cut off or not is confirmed by signals from the voltage detecting circuit (cutoff checking means) 47. Specifically, when the supply line from the driving power source V1 is on, the voltage detection signal connecting terminal 52 of the main controller 35 is Lo. However, when the supply line from the driving power source V1 comes into off with the main controller 35 outputting a stop signal without failure and executing an extinction operation (cutoff operation), low voltage is applied to the voltage detection signal connecting terminal 52 of the main controller 35. Consequently, it is confirmed whether the supply line from the driving power source V1 comes into off if and when a predetermined voltage is applied to the voltage detection signal connecting terminal 52.

Still further, whether the extinction operation is executed without failure may be also determined based on solenoid valve monitoring signals outputted from the solenoid valve monitoring circuits 61 and 62.

When the sub controller 36 detects an anomaly, the sub controller 36 outputs a stop signal to cut off a current to be supplied to the device driving circuit 42, thereby closing the solenoid valves 10, 11, 12, and 16. Specifically, when the sub controller 36 detects an anomaly, the stop signal output terminal 51 becomes open so as to open the base of the transistor Q4, thereby turning off the transistor Q4. That turns off the transistors Q3 and Q2, so that a current to be supplied to each of the relays RL10, RL11, RL12, and RL16 is cut off. As a consequence, a current to be supplied to each of the solenoid valves 10, 11, 12, and 16 is cut off, making each of the solenoid valves 10, 11, 12, and 16 closed, so that gas supply is stopped.

Since the anomaly criteria of the sub controller 36 are higher than those of the main controller 35 as described above, if and when the main controller 35 normally operates, signals' outputted from the main controller 35 close each of the solenoid valves 10, 11, 12, and 16. That prevents the sub controller 36 from reacting by fluctuation of a combustion state anticipated by the main controller 35 and avoids combustion stopping when combustion is not expected to be stopped, achieving convenience.

When the sub controller 36 determines a situation as an anomaly or a danger and cuts off a current supplied to the device driving circuit 42, the sub controller 36 simultaneously outputs a reset signal to the main controller 35. The main controller 35 having received the reset signal is stopped, rebooted, and initialized.

Specifically, since the anomaly criteria by the sub controller 36 are higher than those by the main controller 35 as described above, the main controller 35 should detect the anomaly on ahead if the main controller 35 normally operates. Consequently, if the sub controller 36 detects an anomaly or a danger, the main controller 35 may have some troubles. Thus, the present embodiment reboots the main controller 35 by a command of the sub controller 36 in the case that the sub controller 36 detects an anomaly or a danger.

Since the fact that the main controller 35 detects an anomaly to cut off a current to be supplied to the device driving circuit 42 is an evidence for a normal operation of the main controller 35, it is not necessary to reset the main controller 35. Obviously, it is not necessary to reboot the sub controller 36.

Being rebooted, the main controller 35 restarts to communicate with the sub controller 36. If communication with the sub controller 36 is impossible at this time, information of failure of communication is recorded in the nonvolatile storage element 70 (EEPROM). The information is read out in maintenance and helps with a repair or the like.

The main controller 35 performs recording into the nonvolatile storage element 70 (EEPROM).

Then, a display or an alarm not shown notifies of an anomaly. An error indication showing failure of communication is shown on the display, for example.

In the case that communication with the sub controller 36 cannot be restarted after the main controller 35 is rebooted, operation is not recovered to an "operation ON mode" because a normal combustion operation or a prompt action in the event of an anomaly cannot be expected.

Herein, the "operation ON mode" denotes a standby mode to wait in a preparatory state of combustion, whereas a mode in which combustion cannot immediately start is an "operation OFF mode."

In the case that communication is restarted, whether the recent stopping of the main controller 35 has been caused by the reset signal transmitted from the sub controller 36 or not is confirmed in reference to a message transmitted from the sub controller 36. In other words, the stopping of the main controller 35 is determined as to whether it is based on detection of some sort of an anomaly or a dangerous situation by the sub controller 36. Further, whether the sub controller 36 has detected an anomaly of the main controller 35 as described above to reset the main controller 35 is determined.

As described above, in the combustion control device 27 in the present embodiment, the sub controller 36 receives signals from the part such as the sensor as well as the main controller 35. Thus, the sub controller 36 determines an anomalous situation using its own criteria, so as to execute cutoff to cut off fuel supply and to reboot the main controller 35 as well. The combustion control device 27 in the present embodiment allows in principal the main controller 35 to be recovered to an operation mode before stopping, but immediate restart of combustion should not be executed in the case that combustion is stopped by detection of an anomaly by the sub controller 36. Thus, if and when a message from the sub controller 36 reveals that the recent stopping has been caused by detection of an anomaly by the sub controller 36, the main controller 35 records this situation into the nonvolatile storage element 70 (EEPROM) and makes a predetermined display. The display at this time shows an error indication indicating the cause of stopping.

Similarly, in the case that the sub controller 36 has detected an anomaly of the main controller 35 to reset the main controller 35, operation is stopped without being recovered to an operation ON mode.

Still further, the combustion apparatus in the present embodiment has a specific combustion stopping function. Specifically, the control device in the present embodiment closes the main solenoid valves 16 and the gas solenoid valves 10, 11, and 12 when there is a predetermined difference between signals inputted from each sensor into the main controller 35 and signals inputted from each sensor into the sub controller 36.

In the present embodiment, as the signals from the part such as the sensor is inputted into the main and sub controllers 35 and 36 in parallel, the signals of the two controllers are identical with each other. Though the signals should theoretically be completely identical with each other, some errors may be observed in effect in analog-digital conversion. However, in the case that the signals of the two controllers differ from each other beyond the scope of assumption, a failure such as wire breaking or short circuit is suspected. Thus, the present embodiment compares signals inputted from each sensor into the main controller 35 with signals inputted from each sensor into the sub controller 36, and closes the main solenoid valve 16 and the gas solenoid valves 10, 11, and 12 when a predetermined difference exists between them.

The signals of the two controllers are compared by the main controller 35. In the combustion control device 27 in the present embodiment, the two controllers 35 and 36 carry out bidirectional data communication, whereby information loaded into the sub controller 36 from e.g. each sensor is transmitted to the main controller 35. Then, the main controller 35 compares between the two. When there is a difference of 20% or more between the two, for example, the main controller 35 outputs a stop signal to close the main solenoid valve 16 and the gas solenoid valves 10, 11, and 12. Though the difference to determine a situation as an anomaly between signals inputted into the two controllers 35 and 36 can be set at will, it is preferable to determine the situation as an anomaly when there is a difference of about 10 to 30%.

The above-mentioned embodiment shows a preferred embodiment of the present invention, and various modifications may be made to the present invention without being limited thereto and within the scope of the present invention.

For example, the present invention is applied to the gas water heater in the above-mentioned embodiment, but is not limited thereto and is applicable to a water heater using oil as fuel. Further, the present invention is applicable to a combustion apparatus provided with a combustion part other than a water heater (an air-heating monofunctionalized combustion apparatus, for example).

Further, in the above-mentioned embodiment, the flame detecting circuit 55, the water flow rate detecting circuit 56, the supplied hot-water temperature sensor 57, the fan rotation number detecting circuit 58, the burner sensor circuit 59, the proportional valve current detecting circuit 60, the main solenoid valve monitoring circuit 61, and the gas solenoid valve monitoring circuit 62 are connected to the main and sub controllers 35 and 36 via the bus line 37, but all of them are not indispensable. A normal wiring, not via the bus line, may obviously connect each circuit to the controllers 35 and 36. Still further, in addition to them, signals such as signals for measuring a temperature of the heat exchanger 18, signals for measuring a temperature of a combustion shell (not shown), or signals from the temperature sensor 28 for high-temperature water may be inputted to the main and sub controllers 35 and 36.

The invention claimed is:

1. A combustion control device comprising:

a power cutoff circuit electrically connected to a first output terminal line and a second output terminal line, either a first stop signal or a second stop signal controlling said power cutoff circuit to inhibit a supply of fuel to an element;

a monitoring circuit configured to detect a first criterion of a system component and to detect a second criterion of the system component, a monitoring signal being output from said monitoring circuit;

a sub controller configured to output said first stop signal onto said first output terminal line only when a first input signal indicates an existence of the first criterion, said first input signal being said monitoring signal that has been received by said sub controller;

a main controller configured to output said second stop signal onto said second output terminal line when a second input signal indicates the existence of the second criterion, said second input signal being said monitoring signal that has been received by said main controller, wherein said main controller is configured to detect a difference between said second input signal and said first input signal.

2. The combustion control device as defined in claim 1, wherein said main controller is configured to output said second stop signal onto said second output terminal line when said main controller detects said difference.

3. The combustion control device as defined in claim 1, wherein said first criterion differs from said second criterion.

4. The combustion control device as defined in claim 1, wherein said monitoring signal is simultaneously receivable by said main controller and said sub controller.

5. The combustion control device as defined in claim 1, wherein said sub controller is configured to output a first normal operation signal onto said first output terminal line.

6. The combustion control device as defined in claim 5, wherein said sub controller configured to output said first normal operation signal onto said first output terminal line when said first input signal indicates a nonexistence of the first criterion.

7. The combustion control device as defined in claim 5, wherein said sub controller configured to output said first normal operation signal onto said first output terminal line when said main controller outputs said second stop signal onto said second output terminal line.

8. The combustion control device as defined in claim 1, wherein said main controller is configured to output a second normal operation signal onto said section output terminal line.

9. The combustion control device as defined in claim 8, wherein said main controller configured to output said second normal operation signal onto said second output terminal line when said second input signal indicates a nonexistence of the second criterion.

10. The combustion control device as defined in claim 8, wherein said main controller configured to output said second normal operation signal onto said second output terminal line when said sub controller outputs said first stop signal onto said first output terminal line.

11. The combustion control device as defined in claim 1, wherein an absence of both said second stop signal and said first stop signal controls said power cutoff circuit to permit said supply of the fuel to said element.

12. The combustion control device as defined in claim 1, wherein said system component is from the group consisting of a flame rod, a water flow rate sensor, a temperature sensor, a rotation number detecting sensor, a burner sensor, and a valve.

13. The combustion control device as defined in claim 1, wherein said monitoring signal is from the group consisting of a detection signal from a flame detector, a rotation number detection signal from a fan, a detection signal from a flame temperature detector, an actuating signal from a fuel control valve, and a detection signal from a device temperature detector.

14. The combustion control device as defined in claim 1, wherein a processing speed of the sub controller is inferior to a processing speed of the main controller.

15. The combustion control device as defined in claim 1, wherein said fuel is from the group consisting of gas and oil.

16. The combustion control device as defined in claim 1, wherein said element is said system component.

17. The combustion control device as defined in claim 1, wherein said element is a heating element.

18. The combustion control device as defined in claim 1, wherein said element is configured to heat a liquid.

19. The combustion control device as defined in claim 1, wherein said main controller is configured to control an operation of said element.

* * * * *